US010493330B2

(12) United States Patent
Amundsen

(10) Patent No.: US 10,493,330 B2
(45) Date of Patent: Dec. 3, 2019

(54) OFFSET GOLF CLUB HEAD

(71) Applicant: William L. Amundsen, Rolling Meadows, IL (US)

(72) Inventor: William L. Amundsen, Rolling Meadows, IL (US)

( * ) Notice: Subject to any disclaimer, the term of this patent is extended or adjusted under 35 U.S.C. 154(b) by 0 days.

(21) Appl. No.: 15/897,329

(22) Filed: Feb. 15, 2018

(65) Prior Publication Data

US 2018/0229087 A1 Aug. 16, 2018

Related U.S. Application Data

(60) Provisional application No. 62/459,365, filed on Feb. 15, 2017.

(51) Int. Cl.

| | |
|---|---|
| ***A63B 53/04*** | (2015.01) |
| ***A63B 53/02*** | (2015.01) |
| ***A63B 53/00*** | (2015.01) |
| ***A63B 60/40*** | (2015.01) |
| ***A63B 60/02*** | (2015.01) |
| *A63B 102/32* | (2015.01) |

(52) U.S. Cl.

CPC ..... *A63B 53/02* (2013.01); *A63B 53/007* (2013.01); *A63B 53/04* (2013.01); *A63B 53/0466* (2013.01); *A63B 53/0487* (2013.01); *A63B 60/02* (2015.10); *A63B 60/40* (2015.10); *A63B 2053/0491* (2013.01); *A63B 2102/32* (2015.10)

(58) Field of Classification Search

CPC ... A63B 53/02; A63B 53/007; A63B 2102/32; A63B 53/0466; A63B 2053/0491; A63B 53/0487; A63B 53/047; A63B 60/40; A63B 60/20

See application file for complete search history.

(56) References Cited

U.S. PATENT DOCUMENTS 1,657,972 A * 1/1928 Rowe ..... A63B 53/065 473/248
3,981,507 A * 9/1976 Nunziato ..... A63B 53/0487 473/327
4,260,157 A * 4/1981 Jones ..... A63B 53/04 473/165
4,345,763 A * 8/1982 Swanson ..... A63B 53/00 473/242
4,390,184 A * 6/1983 Rudell ..... A63B 53/0487 473/253
4,512,583 A * 4/1985 Leveque de Vilmorin ..... A63B 53/04 473/245
5,338,029 A * 8/1994 Falzone ..... A63B 60/00 473/314
5,340,104 A * 8/1994 Griffin ..... A63B 53/02 473/340

(Continued)

FOREIGN PATENT DOCUMENTS

JP 2007044440 A * 2/2007 ..... A63B 53/02

*Primary Examiner* — Stephen L Blau

(74) *Attorney, Agent, or Firm* — Charles F. Meroni, Jr.; Meroni & Meroni, P.C.

(57) ABSTRACT

A golf club head or gold club, the club including a shaft, a body, a front face, a back face, and a connecting member. The connecting member attached to the center of the back face and extending away from the back face of the club head and turning at an angle, and wherein the front face of the club head forms a rectangular shape.

4 Claims, 4 Drawing Sheets

(56) References Cited

U.S. PATENT DOCUMENTS

| | | | | | |
|---|---|---|---|---|---|
| 5,531,445 | A * | 7/1996 | Levocz | A63B 53/02 | 473/341 |
| 5,709,613 | A * | 1/1998 | Sheraw | A63B 53/02 | 473/248 |
| 5,716,288 | A * | 2/1998 | Sacco | A63B 53/04 | 473/290 |
| 5,795,246 | A * | 8/1998 | Hale | A63B 53/0487 | 473/314 |
| 6,435,976 | B1 * | 8/2002 | Galliers | A63B 53/02 | 473/244 |
| 6,497,626 | B1 * | 12/2002 | Sundberg | A63B 53/007 | 473/248 |
| 6,514,153 | B2 * | 2/2003 | Miyamoto | A63B 60/00 | 473/305 |
| 6,623,375 | B2 * | 9/2003 | Davies | A63B 53/02 | 473/314 |
| D516,149 | S * | 2/2006 | Gibson | D21/742 | |
| D534,596 | S * | 1/2007 | Haga | D21/747 | |
| 7,429,218 | B2 * | 9/2008 | Pinder | A63B 53/02 | 473/244 |
| 9,079,077 | B2 * | 7/2015 | Wolf | A63B 53/0487 | |
| 2007/0015607 | A1 * | 1/2007 | Hot | A63B 60/62 | 473/372 |
| 2007/0042831 | A1 * | 2/2007 | Haines | A63B 53/02 | 473/313 |
| 2013/0053166 | A1 * | 2/2013 | Tobian | A63B 53/007 | 473/307 |
| 2017/0189782 | A1 * | 7/2017 | Jones | A63B 69/3661 | |

* cited by examiner

OFFSET GOLF CLUB HEAD

FIELD OF THE INVENTION

The present invention generally relates to golf clubs used both recreationally and professionally. In particular, the current invention represents an improved design for club heads.

BACKGROUND

Golf is a well-known competitive sport and improvements in golf club and golf ball technology represent a fascination among both professionals and hobbyists. Indeed, golf is considered a difficult and competitive sport/hobby for many people. Many proposals have been made to design golf clubs which provide improved control over, and feel for, the golf ball, for example by providing grooves on the impact face of the golf club head. When your average golfer swings a golf club, he or she may have dramatic variations in his or her golf swing, resulting in numerous off-center hits, which result in diminished performance when compared to a direct center hit. However, in an attempt to make this very difficult game more enjoyable for the average golfer, golf club designers have come up with unique golf club designs that will mitigate the harsh realities of a less than perfect golf swing.

Despite all of the attempts to improve the performance of a golf club head all while trying to minimize the sacrifice in feel of a golf club, the predominant designs of golf clubs and club heads do not transmit maximum force through the head of the golfer's swing to the ball. Other patents have attempted to solve the ideal golf club design, but predominantly have failed to deliver every promised feature at once.

U.S. Pat. No. 723,534 ('534 Patent), issued to Knight, describes a golf club in which the center of the shaft is connected to the head forward of the center mass in the direction of delivery of the blow and at a point between the heel and toe of the club-head. It comprises also a head having a striking face along its major axis, with the shaft connection at a point forward of the center of mass.

U.S. Pat. No. 4,330,128 ('128 Patent), issued to Morelli, describes a golf putter having, in combination, a putting head and an elongate article, such as a bottle, a portion of which constitutes the putting surface. The putter comprises a generally flat, vertically oriented driving element attached to the putter shaft, with an aperture formed in the driving element of sufficient dimension to accept the elongate article. A receptor, spaced from the driving element by an arm extending between the receptor and the driving element, is shaped to engage one end of the elongate article and retain the article with part of the article being situated within the aperture. That portion of the elongate article extending from the aperture on the side of the driving element opposite from the receptor constitutes the putting surface.

U.S. Pat. No. 6,383,089 ('089 Patent), submitted by Bonneau, describes a putter head fashioned from a block metal having a conventional face, but having a mass relieved portion behind the face, with greatest mass relief at the sole of the club and a lesser amount of mass relief extending upwardly to the top surface of the club which has conventional dimensions and shape. Since the greatest amount of mass relief is at the bottom of the club, the mass relief is said to be inverted. A pair of inclined ribs behind the central portion of the face add stiffness to the club. The club has a raised center of gravity intended to be in alignment with the center of a golf ball. A plug of heavy metal may be centered on the center of gravity to add stiffness at the zone. Although the club would typically be made out of aluminum or steel, a club, without the plug, could be made of an ultra-heavy metal, such as depleted uranium, and be no heavier than a regular club due to the inverted mass relief.

U.S. Pat. No. 8,480,515 ('515 Patent), which issued to Roach et el., describes a golf club head having a translucent insert disclosed. The club head includes a body defining a striking face, a top line, a sole, a back, a heel, and a toe. The back contains a cavity that extends in a direction substantially perpendicular to the face. A recess is provided within the cavity, with the recess extending away from the cavity and toward the sole. A translucent insert, such as a vibration dampening member, may be provided within the recess. The insert may contain secondary inserts, such as weight members, therein in strategic locations. The insert may completely fill the recess, or may fill only a portion thereof.

United States Patent Application No. 2011/0014992, submitted by Morrissey, describes a golf club which includes a head and a shaft coupled to the head. The shaft is positioned so that an axis of the shaft intersect at or near a center of mass of the head.

These problems, and others, have been addressed by the improved golf club heads disclosed herein and discussed in greater detail below.

BRIEF SUMMARY

Thus, to solve such problems and others, it is proposed to re-design the connection of the shaft to the golf club head, connecting the shaft to the rear of the golf club head. This then will afford the maximum force of the golfer's swing to the golf club head resulting in greater flight distance of the golf ball with little or no deflection of the golf club head or twisting of the gold club shaft causing the ball to fly in errant directions.

This is to be contrasted with most current designs that allow significant deflection of the club head and twisting of the shaft (which is essentially a hollow tube) which contribute to a loss of distance that the ball flies.

Another benefit that can be afforded in the present design is that the club head/shaft connection will allow for a golf club head that is a full rectangular shape rather than the currently used tear drop shape. This rectangular shape provides a larger striking area that has a concentrated center point of force, rather than an off-center, remote point of force.

Manufacturing of such club heads could continue using the casting methods traditionally used by current manufacturers. However, the shaft would instead be centered to the rear of the golf club head. This would also allow the casting of the golf club head and stem connection to the shaft at the same time. This can result in a stronger continuity of materials rather than connecting the stem to the golf club head in a second operation. Varying degrees of angle for the club head to the golfer's hands can be designed into the moulds.

The advantages of such an application become clear when one is experienced with golf clubs, or golf club manufacturing. Typical devices currently on the market do not have the confluence and plethora of features contemplated and described herein.

In a first embodiment the disclosure contemplates a golf club including a shaft; and a club head, the club head having a body, a front face, and a back face, the shaft connected to the club head at the center of the back face by a connecting member, the connecting member extending away from the back face of the club head and turning to connect to the shaft; and wherein the front face of the club head forms a rectangular shape.

In another embodiment the disclosure contemplates a golf club head including a body, a front face, a back face, and a connecting member; the connecting member attached to the center of the back face and extending away from the back face of the club head and turning at an angle; and wherein the front face of the club head forms a rectangular shape.

In another embodiment the disclosure contemplates a golf club, including a shaft; and a body including: a ball striking face; a back face defined in the body at a location behind the ball striking face; a connection point extending in a direction away from the back face, wherein the connection point is connected to the center of mass of the body; wherein the connection point turns upwards and connects to the shaft; the striking face adapted for striking a ball.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

DESCRIPTION OF THE DRAWINGS

The present invention may be better understood, and its numerous objects, features, and advantages made apparent to those skilled in the art by referencing the accompanying drawings.

DETAILED DESCRIPTION

Referring now the drawings with more specificity, the present invention essentially provides an improved golf club and golf club heads. The preferred embodiments of the present invention will now be described with reference to FIGS. 1-11 of the drawings. Variations and embodiments contained herein will become apparent in light of the following descriptions.

Figure 1:
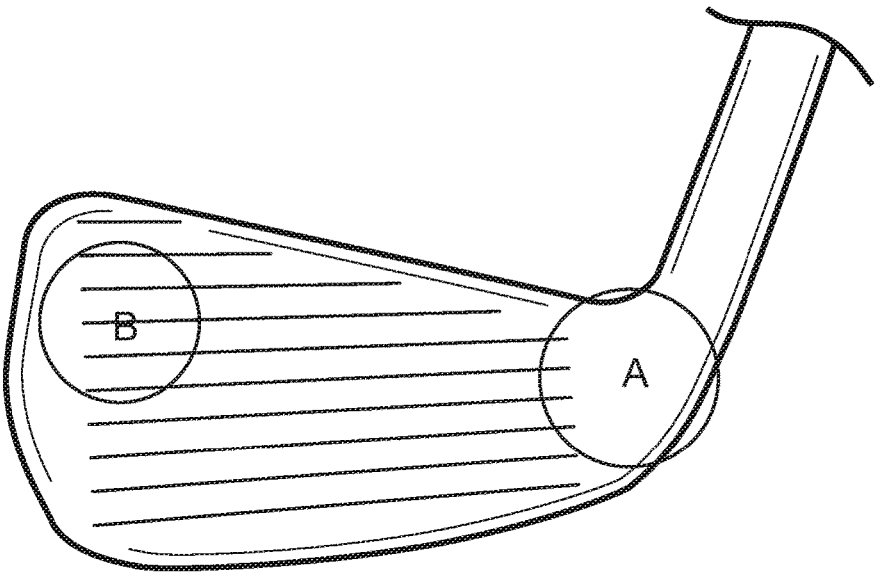
FIG. 1 is a front view of a club head and connection of the golf club head to the shaft.
Figure 2:
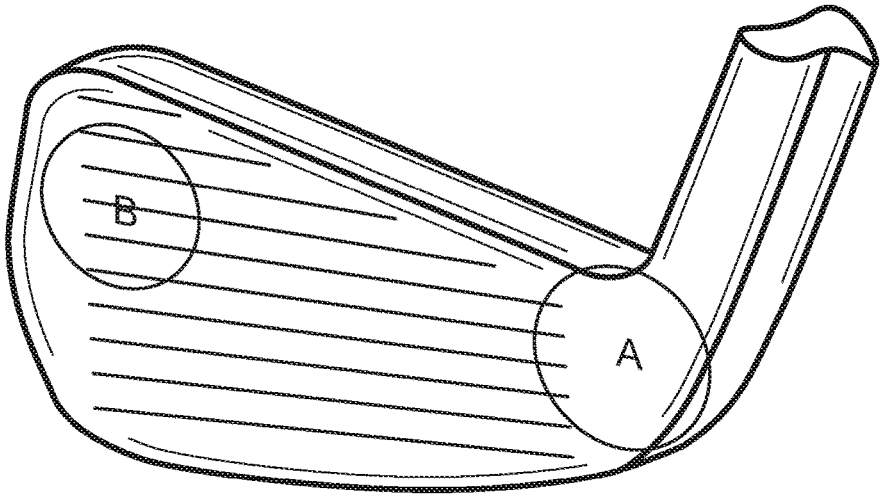
FIG. 2 is an angled view of the club head of FIG. 1.

Looking now to FIGS. 1 & 2 a more traditional form of golf club is depicted. In most instances as a golfer addresses the golf ball, his endeavor is to locate the strike zone of the club head and golf ball as close to the bulge of the club shaft connection as possible in order to gain as much benefit if the golfer's swing as possible. Any slight modification of the golfer's swing will result in the golf ball striking the club shaft mounting as (at circles "A") or striking the ball at the flag end of the club head (circles "B"). Striking the golf ball at either circle "A" or circle "B" will result in ball flight off-course of landing in a less desirable location. Striking the golf ball at circle "B", the flag end of the club head, causes off-course direction because the flag end of the club head is remote from the club shaft mount and the force of the gold ball strike causes the flag end, circle "B", to deflect thereby directing the ball flight off course to land in a less desirable location.

Figure 3:
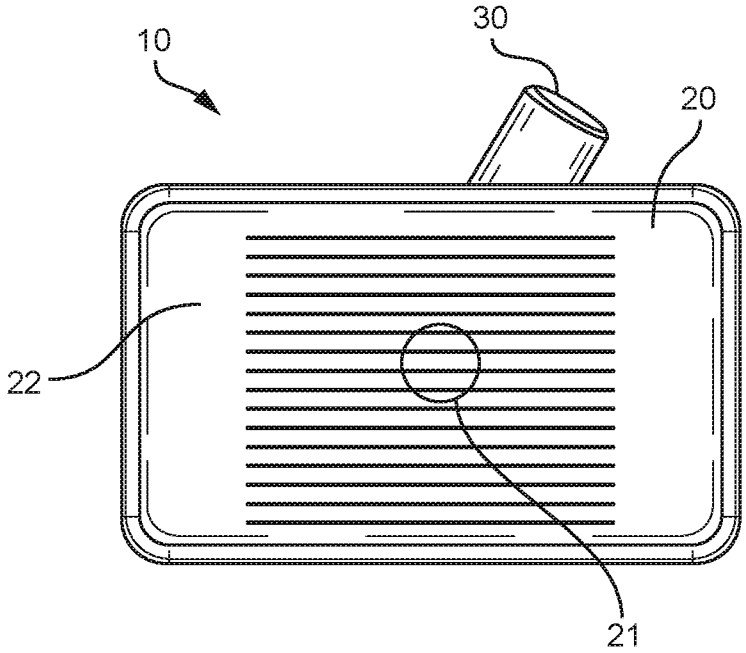
FIG. 3 is a front view of a rectangular golf club head as described in the present disclosure.

Turning now to FIGS. 3. & 4. a first embodiment of a club 10 according to the present disclosure is show. Club 10 is a replacement for traditional "irons" used by golfers. This club 10 connects club head 20 to shaft 30 at the center of the club head 21 at connection point 31. This results in the full power of the golfer's swing being transmitted directly to a golf ball resulting in a longer flight. Because this new design results in the club head (20) taking the shape of a rectangle as shown in FIG. 3 connecting the club shaft 30 to the center of the rear (at 31) of the club head 20, results in a club face 22 without any obstruction allowing the ball flight direction to be more in the control of the golfer. The top face 40 of the embodiment is contoured to improve performance, by shifting the center of mass and changing the total mass of the club head 20. This shape is substantially similar to a curved "E" as depicted with the club shaft passing between two of the "E"'s prongs.

Figure 5:
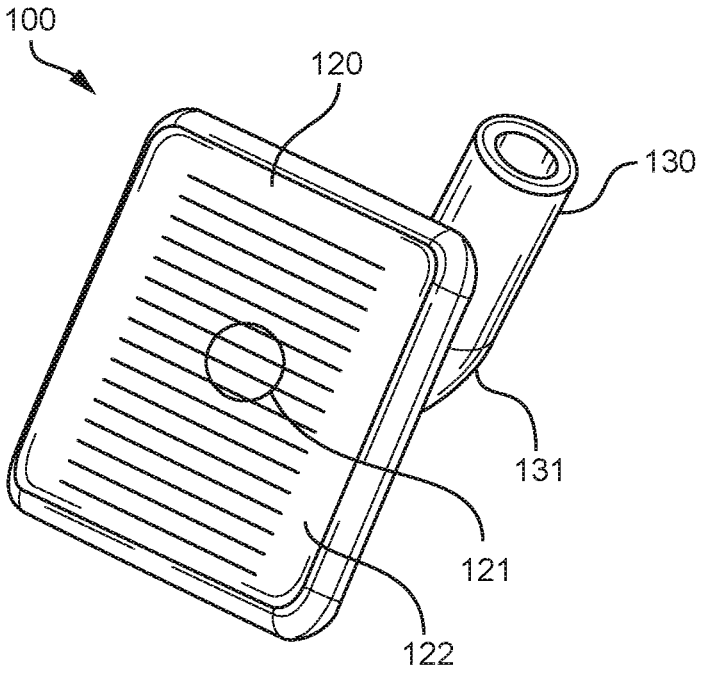
FIG. 5 is front perspective view of a second embodiment of a rectangular golf club head as described in the present disclosure.

Turning now to FIGS. 5. & 6. a second embodiment of a club 100, according to the present disclosure, is show. Club 100 is a similar to club 10 in that it also is a replacement for traditional "irons" used by golfers. This club 100 connects club head 120 to shaft 130 at the center of the club head 121 at connection point 131. This results in the full power of the golfer's swing being transmitted directly to a golf ball resulting in a longer flight. However, unlike in club 10 this new design results in the club head 120 taking the shape of a square as shown in FIG. 5 connecting the club shaft 130 to the center of the rear (at 131) of the club head 120, results in a club face 122 without any obstruction allowing the ball flight direction to be more in the control of the golfer. It should be noted that while club 10 is shown as a rectangle and club 100 as a square, both can be adapted to use either a square or rectangular clubface, depending on the desired performance of the club.

Figure 7:
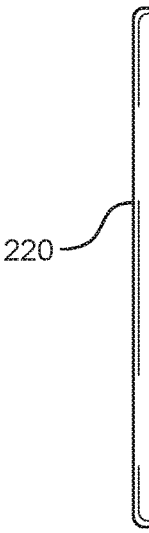
FIG. 7 is a top view of another embodiment of a golf club head according to this disclosure.
Figure 8:
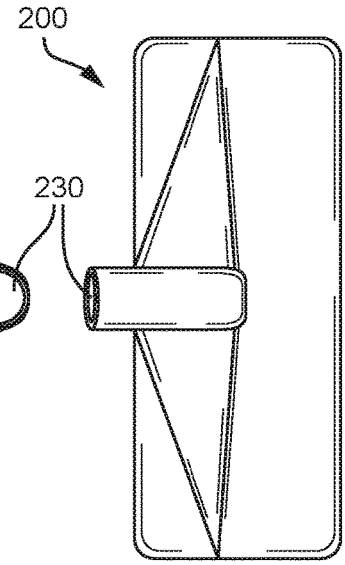
FIG. 8 is a back view of the club head of FIG. 7.
Figure 9:
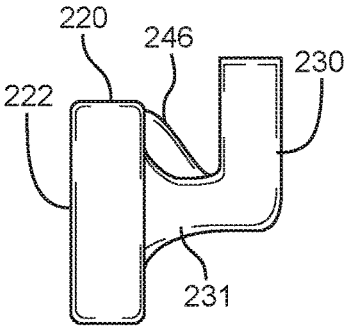
FIG. 9 is a side on view of the golf club head of FIGS. 7 &8.

Turning now to FIGS. 7, 8, & 9. a club 200, according to the present disclosure, is show. Club 200 is a replacement for traditional "putters" used by golfers. This club 200 connects club head 220 to shaft 230 at the center of the club head 221 at connection point 231. In this application, it typically will provide greater control and stability when striking the ball compared to traditional putters. In this way clubface 222 is less likely to turn on impact unless so directed by the golfer. Club 200 is typically constructed as a rectangle, with supportive backing or weight assembly 240. Said weight assembly angles from the top of the backside of the club head 220 towards connection point 231 and forms a triangle from both the topside and backside views (as seed in FIGS. 7 & 8).

Figure 10:
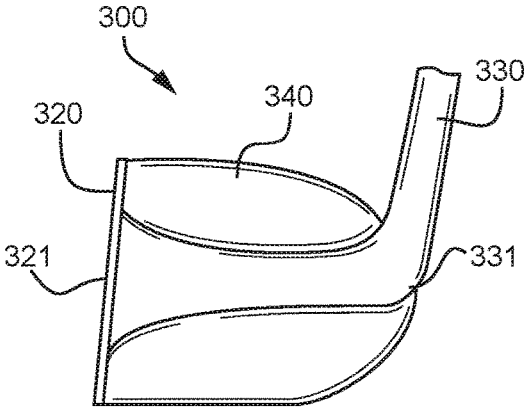
FIG. 10 is a side on, semi-transparent view of another embodiment of a golf club head according to the present disclosure.
Figure 11:
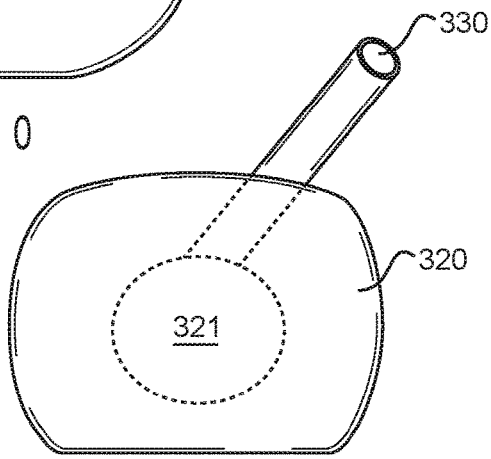
FIG. 11 is a front view of the golf club head of FIG. 10.

Turning finally to FIGS. 10 & 11. an embodiment of a club 300, according to the present disclosure, is show. Club 300 is a replacement for traditional "woods" used by golfers. This club 300 connects club head 320 to shaft 330 at the center of the club head 321 at connection point 331. As with the "irons" presented above, this results in the full power of the golfer's swing being transmitted directly to a golf ball resulting in a longer flight, along with greater stability on impact. However, unlike in club 10 this new design results in the club head 120 being supported by additional support or weight assembly 340. The weight assembly 340 encompassing the connection point 331 at all sides and extending away from the back side towards the shaft 330. The club shaft 330 remains connected to the center of the rear (at 331) of the club head 320. It should be noted that while club 10 is shown as a rounded rectangle it can be adapted to both square and rectangle configurations.

Figure 4:
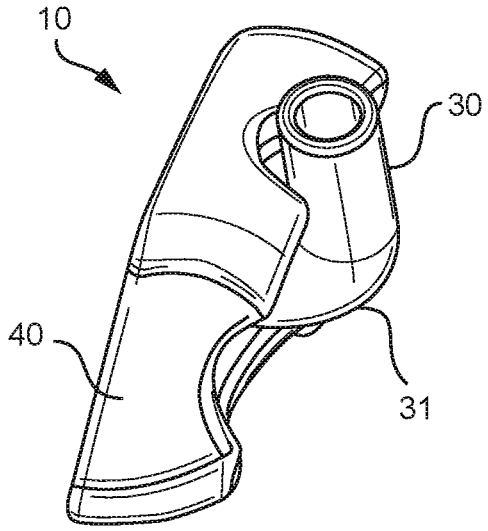
FIG. 4 is a top angled view of a golf club head of FIG. 3 as described in the present disclosure.
Figure 6:
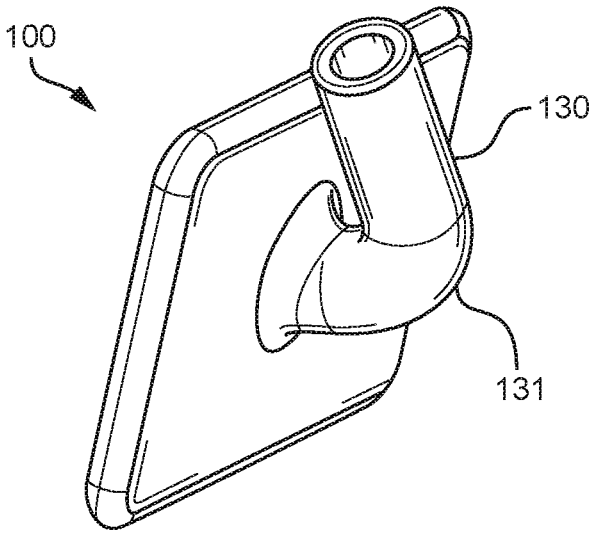
FIG. 6 is a back side perspective view of the golf club head of FIG. 5.

As shown in FIGS. 7-11 the connection point (231, 331) may be substantially tapered, or it may be more uniform in thickness as shown in FIGS. 4 & 6 tapering of connection points can provide additional strength, but is not desirable in every application.

INDUSTRIAL APPLICABILITY

A review of the benefits of the novel golf clubs (10, 100, 200, 300) contained herein follows. 1. The full power of the golfer's swing is directed immediately to the golf ball contributing to additional yards of flight of the golf ball. 2. There is no change in the golfer's stance as he addresses the gold ball to drive, approach, chip or putt. 3. This new design of club head eliminates the two existing problems now a part of the tear shaped golf club, presently the only shaped golf club available.

The newly designed club heads (20, 120, 230, 330) result in a flat faced club head which does not have a protrusion on one end near where the golf ball is struck or the end remote from the source of power of the golfer's swing, all affecting the direction of the golf ball flight head strike. Also, when a golf ball has landed in the "rough", the grasses are higher than the golf ball, to very high resulting in a very difficult shot. This hazard, the "rough", provides great resistance to current club designs. This resistance from the taller grasses causes the flag end of the golf club to retreat, thereby affecting the flight direction of the golf ball. However, this problem can be at least partially overcome by the greater force and stability provided by the clubs disclosed herein.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A golf club comprising:

a shaft; and a clubhead, the clubhead having a body, a front face, and a back face, the shaft connected to the clubhead at the center of the back face by a connecting member, the connecting member extending away from the back face of the clubhead and turning to connect to the shaft;

wherein the front face of the clubhead forms a rectangular shape and wherein the clubhead further comprising a contoured top side, the top side appearing substantially similar to a curved, "E"-shape when viewed from above.

2. The golf club of claim 1 wherein:

the front face of the clubhead forms a square shape.

3. The golf club of claim 1 wherein:

the golf club is an iron.

4. The golf club of claim 3 wherein:

the shaft passes between two prongs of the "E"-shape of the contoured top side.

* * * * *